US009056339B2

(12) United States Patent
Smith et al.

(10) Patent No.: US 9,056,339 B2
(45) Date of Patent: Jun. 16, 2015

(54) AIRFOIL AND BAFFLE ASSEMBLIES THAT REDUCE AIRFLOW REQUIREMENTS FOR FUME HOODS AND FUME HOODS INCORPORATING SAME

(75) Inventors: Thomas C. Smith, Raleigh, NC (US); Paul C. Curd, Siler City, NC (US); Tam N. Trinh, Asheboro, NC (US)

(73) Assignee: Exposure Control Technologies, Inc., Cary, NC (US)

( * ) Notice: Subject to any disclaimer, the term of this patent is extended or adjusted under 35 U.S.C. 154(b) by 968 days.

(21) Appl. No.: 12/870,046

(22) Filed: Aug. 27, 2010

(65) Prior Publication Data

US 2012/0052784 A1 Mar. 1, 2012

(51) Int. Cl.

| | |
|---|---|
| ***B08B 15/02*** | (2006.01) |
| ***F24F 7/00*** | (2006.01) |
| ***F24F 11/00*** | (2006.01) |
| ***F23J 11/00*** | (2006.01) |
| ***F24F 13/00*** | (2006.01) |
| ***F24C 15/20*** | (2006.01) |
| *B01L 1/00* | (2006.01) |

(52) U.S. Cl.
CPC ... *B08B 15/02* (2013.01); *B01L 1/00* (2013.01)

(58) Field of Classification Search
None
See application file for complete search history.

(56) References Cited

U.S. PATENT DOCUMENTS

| | | | | | |
|---|---|---|---|---|---|
| 2,702,505 | A | * | 2/1955 | Nelson | 454/62 |
| 2,819,666 | A | * | 1/1958 | McNeil et al. | 454/59 |
| 3,000,292 | A | * | 9/1961 | Wojan | 454/59 |
| 3,111,077 | A | * | 11/1963 | Cortright | 454/59 |
| 3,217,630 | A | * | 11/1965 | Katzfey et al. | 454/62 |
| 3,218,953 | A | * | 11/1965 | Grow et al. | 454/62 |
| 3,237,548 | A | * | 3/1966 | Bayern | 454/59 |
| 3,254,588 | A | * | 6/1966 | Truhan | 454/58 |
| 3,318,227 | A | * | 5/1967 | Nelson et al. | 454/59 |
| 3,747,504 | A | * | 7/1973 | Turko et al. | 454/59 |
| 3,897,721 | A | * | 8/1975 | Fuhst | 454/59 |
| 4,023,473 | A | | 5/1977 | Russell | |

(Continued)

FOREIGN PATENT DOCUMENTS

GB 1146778 A * 3/1967 ..... B08B 15/023

OTHER PUBLICATIONS

Written Opinion of the International Preliminary Examining Authority Corresponding to International Application No. PCT/US2011/045648; Date of Mailing: Aug. 31, 2012; 5 pages.

(Continued)

*Primary Examiner* — Gregory Huson
*Assistant Examiner* — Eric Gorman
(74) *Attorney, Agent, or Firm* — Myers Bigel Sibley & Sajovec

(57) ABSTRACT

A fume hood includes a ventilated chamber having an access opening. A first elongated airfoil assembly is attached to an edge portion of a floor that extends from the opening. A sash is slidably mounted at the access opening and a second elongated airfoil assembly is attached to a lower edge of the sash. The first elongated airfoil assembly includes a plurality of elongated vanes in vertically spaced-apart relationship that define air flow channels. The second airfoil assembly includes a pair of elongated vanes in vertically spaced-apart relationship that define air flow channels that extend into the chamber. A baffle assembly is located in front of a rear wall of the chamber and includes a primary panel having a plurality of vertical air-exit slots adjacent a lower edge, and a buffering panel having a plurality of horizontal air-exit slots adjacent an upper portion.

22 Claims, 9 Drawing Sheets

(56) References Cited

U.S. PATENT DOCUMENTS

| | | | | | |
|---|---|---|---|---|---|
| 4,100,847 | A | | 7/1978 | Norton | |
| 4,177,717 | A | * | 12/1979 | Grow et al. | 454/62 |
| 4,177,718 | A | * | 12/1979 | Grow et al. | 454/59 |
| 4,280,400 | A | * | 7/1981 | Longworth | 454/57 |
| 4,377,969 | A | | 3/1983 | Nelson | |
| 4,434,711 | A | * | 3/1984 | Zboralski et al. | 454/62 |
| 4,451,000 | A | * | 5/1984 | Stephens | 228/20.1 |
| 4,534,281 | A | | 8/1985 | Parks et al. | |
| D286,324 | S | | 10/1986 | Parks et al. | |
| 4,785,722 | A | * | 11/1988 | Dollhopf et al. | 454/62 |
| 4,856,420 | A | | 8/1989 | Poblete et al. | |
| 4,934,256 | A | | 6/1990 | Moss et al. | |
| 5,042,456 | A | * | 8/1991 | Cote | 126/299 D |
| 5,167,677 | A | * | 12/1992 | Hammes | 96/17 |
| D346,437 | S | | 4/1994 | Poblete et al. | |
| 5,334,089 | A | | 8/1994 | Beck et al. | |
| 5,378,195 | A | | 1/1995 | Beck | |
| 5,407,389 | A | | 4/1995 | Poblete et al. | |
| 5,413,408 | A | | 5/1995 | Beck et al. | |
| 5,415,583 | A | * | 5/1995 | Brandt, Jr. | 454/61 |
| 5,421,379 | A | * | 6/1995 | Geiser | 141/1 |
| D360,682 | S | | 7/1995 | Gilkison et al. | |
| 5,447,468 | A | | 9/1995 | Tener et al. | |
| 5,582,472 | A | | 12/1996 | Lyons et al. | |
| 5,688,168 | A | | 11/1997 | Schlies | |
| 5,697,838 | A | | 12/1997 | Morris | |
| 5,716,267 | A | | 2/1998 | Hambleton et al. | |
| 5,718,626 | A | | 2/1998 | Rindoks et al. | |
| 5,797,790 | A | | 8/1998 | Rindoks et al. | |
| 5,924,920 | A | | 7/1999 | DeLuca et al. | |
| 6,004,095 | A | * | 12/1999 | Waitz et al. | 415/119 |
| 6,089,970 | A | * | 7/2000 | Feustel | 454/57 |
| 6,131,463 | A | | 10/2000 | Morris | |
| 6,302,779 | B1 | * | 10/2001 | Ryan et al. | 454/61 |
| 6,350,194 | B1 | | 2/2002 | Haugen et al. | |
| 6,368,206 | B1 | | 4/2002 | Hunter et al. | |
| 6,428,408 | B1 | * | 8/2002 | Bell et al. | 454/56 |
| 6,450,875 | B1 | | 9/2002 | Haugen | |
| 6,461,233 | B1 | * | 10/2002 | Gilkison et al. | 454/57 |
| 6,506,109 | B1 | | 1/2003 | Bastian et al. | |
| D472,645 | S | | 4/2003 | Roepke et al. | |
| 6,569,007 | B2 | | 5/2003 | Bastian et al. | |
| 6,582,292 | B1 | | 6/2003 | Bastian | |
| 6,692,346 | B2 | | 2/2004 | Bastian et al. | |
| 6,814,658 | B1 | | 11/2004 | Rindoks et al. | |
| 7,318,771 | B2 | * | 1/2008 | Huang et al. | 454/61 |
| RE40,276 | E | | 4/2008 | Hunter et al. | |
| 7,470,176 | B2 | | 12/2008 | Morris et al. | |
| 2003/0027515 | A1 | * | 2/2003 | Ryan et al. | 454/56 |
| 2003/0109211 | A1 | * | 6/2003 | Bastian | 454/56 |
| 2004/0082292 | A1 | * | 4/2004 | Ryan et al. | 454/56 |
| 2005/0164622 | A1 | * | 7/2005 | Ryan et al. | 454/56 |
| 2007/0021046 | A1 | * | 1/2007 | Huang et al. | 454/61 |
| 2007/0021047 | A1 | * | 1/2007 | Huang et al. | 454/61 |
| 2007/0087677 | A1 | * | 4/2007 | Morris et al. | 454/61 |
| 2007/0093154 | A1 | * | 4/2007 | Simpson | 441/79 |
| 2008/0014080 | A1 | * | 1/2008 | Fang | 415/191 |
| 2009/0301485 | A1 | * | 12/2009 | Kenyon et al. | 128/204.18 |

OTHER PUBLICATIONS

International Preliminary Report on Patentability Corresponding to International Application No. PCT/US2011/045648; Date of Mailing: Jan. 3, 2013; 6 pages.

International Search Report Corresponding to International Application No. PCT/US2011/045648; Date of Mailing: Mar. 8, 2012; 10 pages.

* cited by examiner

AIRFOIL AND BAFFLE ASSEMBLIES THAT REDUCE AIRFLOW REQUIREMENTS FOR FUME HOODS AND FUME HOODS INCORPORATING SAME

FIELD OF THE INVENTION

The present invention relates generally to fume hoods and, more particularly, to apparatus for reducing required airflow into fume hoods.

BACKGROUND

Fume hoods are employed in laboratories and other locations where technicians work with materials that generate dangerous or noxious contaminants. Conventional fume hoods include an enclosed chamber in which work is performed. An access opening is provided in the front of the chamber through which a technician can perform work within the chamber. An exhaust system is configured to exhaust air and contaminants from the chamber to a location outside the fume hood. The exhaust system draws air flow through the access opening and out of the chamber. This inward flow of air is intended to prevent contaminants from exiting the chamber through the access opening.

FIG. 1 illustrates a typical conventional fume hood 10. The illustrated fume hood 10 includes a cabinet 12 having a work chamber 14. The chamber 14 includes a flat bottom floor (surface) 16 on which work is performed within the chamber 14 and an access opening 18 at the front of the chamber 14. A sash 20 is mounted in the cabinet 12 for up and down movement in a vertical plane to open and close the access opening 18. The sash 20 is conventionally formed of transparent material, such as glass, to permit viewing of the chamber 14 therethrough.

In many instances an average face velocity of about 100 feet per minute or greater at the access opening of a fume hood is stipulated in order to prevent harmful contaminants from escaping the chamber through the access opening. Unfortunately, such an air velocity and resultant air volumes may result in the withdrawal of an equivalent amount of air from the room in which a fume hood is located. Since the supply air in most laboratories is heated and cooled and is 100% outdoor air, it is desirable to reduce the amount of conditioned air that is drawn through the fume hoods. It is estimated by some that the cost of moving conditioned air (i.e., heated and cooled air) drawn through a conventional fume hood may exceed $5,000 per year.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

According to some embodiments of the present invention, a fume hood adapted to be connected to an exhaust system includes a ventilated chamber having an access opening and a work space floor, and an elongated airfoil assembly attached to an edge portion of the floor that extends outwardly to the access opening. The airfoil assembly extends substantially the entire span of the access opening and comprises a plurality of elongated vanes in vertically spaced-apart relationship that define a plurality of vertically spaced-apart air flow channels. The air flow channels extend into the chamber through the access opening and are substantially parallel with the surface of the floor. The exhaust system creates air flow into the chamber and the airfoil assembly produces controlled air flow patterns that sweep along the floor surface, even under reduced air flow velocities and volumes.

In some embodiments, the airfoil assembly includes first, second, third, and fourth elongated vanes, wherein each vane has a respective downwardly curved leading edge portion and a respective planar trailing edge portion. The vanes are arranged in a staggered configuration relative to the free end of the floor edge portion, and the leading edge portion of the fourth vane extends furthest from the free end of the floor edge portion, followed by the leading edge portion of the third vane, followed by the leading edge portion of the second vane, and finally by the leading edge portion of the first vane.

In some embodiments, the first, second and third vanes have respective first, second, and third widths, wherein the second width is greater than the first width, and the third width is greater than the second width. In some embodiments, a thickness of the first, second, and third vanes is substantially constant along a width thereof, and the fourth vane has a cross-sectional shape of an airfoil with a generally blunt leading edge portion that tapers to a trailing edge portion.

According to other embodiments of the present invention, a fume hood adapted to be connected to an exhaust system includes a ventilated chamber having an access opening, a sash slidably mounted to the chamber at the access opening and movable between raised and lowered positions, and an elongated airfoil assembly attached to a lower edge portion of the sash. The airfoil assembly extends substantially an entire span of the sash and comprises first and second elongated vanes in vertically spaced-apart relationship that define air flow channels that extend into the chamber through the access opening. Each vane has a cross-sectional shape of an airfoil with a generally blunt, upwardly curved leading edge portion that tapers to a planar trailing edge portion. When air flow is created within the chamber by the exhaust system, the airfoil assembly produces controlled air flow patterns into the chamber that minimizes escape of dangerous contaminants from the chamber.

In some embodiments, the first and second vanes may have different sizes. For example, one of the vanes may have a width (i.e., the distance between leading and trailing edge portions) that is greater than the width of the other vane. In some embodiments, the first and second vanes may have different thicknesses and the amount of curvature of the respective leading edge portions may be different.

According to other embodiments of the present invention, a fume hood adapted to be connected to an exhaust system includes a ventilated chamber having a rear wall, side walls, a ceiling, a floor, an access opening, and a baffle assembly located in front of the rear wall. The baffle assembly includes an upper panel, a primary panel and a buffering panel. The upper panel has a generally rectangular shape and includes opposite upper and lower end portions, and opposite side edges. The upper end portion is attached to the chamber ceiling and the lower end portion is attached to an upper portion of the primary panel. The upper panel side edges are attached to the respective chamber side walls.

The primary panel has a generally rectangular shape with opposite upper and lower end portions and opposite side edges. The primary panel side edges are attached to respective chamber side walls, thus non-movable, and the lower end portion is spaced apart from the chamber floor to provide a generally horizontal air-exit slot along the width of the chamber that allows air to flow into an exhaust system connected to the fume hood. The primary panel includes a plurality of generally vertical air-exit slots adjacent the lower end portion thereof and that are arranged in horizontal spaced-apart relationship.

The buffering panel has a generally rectangular shape with opposite upper and lower end portions and opposite side edges. The upper end portion is attached to the primary panel upper end portion, and the buffering panel side edges are attached to the respective chamber side walls, thus non-movable. The buffering panel is angled away from the primary panel such that the buffering panel lower end portion is spaced apart from the chamber floor and the rear wall to provide a generally horizontal air-exit slot along the width of the chamber that allows air to flow into an exhaust system connected to the fume hood. The buffering panel includes a pair of generally horizontal air-exit slots adjacent the upper portion thereof and that are arranged in horizontal spaced-apart relationship.

According to other embodiments of the present invention, a fume hood adapted to be connected to an exhaust system includes a ventilated chamber having an access opening and a work space floor, a first elongated airfoil assembly attached to an edge portion of the floor that extends outwardly to the access opening, a sash slidably mounted to the chamber at the access opening and movable between raised and lowered positions, and a second elongated airfoil assembly attached to a lower edge portion of the sash. The first elongated airfoil assembly extends substantially an entire span of the access opening and comprises a plurality of elongated vanes in vertically spaced-apart relationship that define a plurality of vertically spaced-apart air flow channels. The air flow channels extend into the chamber through the access opening and are substantially parallel with a surface of the floor. The second airfoil assembly extends substantially an entire span of the sash and comprises a pair of elongated vanes in vertically spaced-apart relationship that define air flow channels that extend into the chamber through the access opening. Airflow through the chamber created by the exhaust system causes the first airfoil assembly to produce controlled air flow patterns that sweep along the floor surface, and also causes the second airfoil assembly to produce controlled air flow patterns into the chamber.

In some embodiments, the fume hood includes a baffle assembly located in front of a rear wall of the chamber. The baffle assembly includes a primary panel and a buffering panel positioned between the primary panel and rear wall so as to define an air flow path between the primary panel and buffering panel. The primary panel has opposite side edges attached to respective chamber side walls and a lower edge spaced apart from the chamber floor. A plurality of generally vertical air-exit slots are formed within the primary panel adjacent the lower edge thereof in horizontal spaced-apart relationship. The buffering panel has opposite side edges attached to the respective chamber side walls and a lower edge spaced apart from the chamber floor. A pair of generally horizontal air-exit slots are formed within the buffering panel adjacent the upper portion thereof in horizontal spaced-apart relationship.

The airfoil assemblies and baffle assembly, according to embodiments of the present invention, reduce the air velocity and volumes required for safe operation of fume hoods and can improve the containment of contaminants therewithin. In addition, fume hoods fitted with the baffle assembly and airfoil assemblies, according to embodiments of the present invention, can have equivalent openings as conventional fume hoods and still meet safety requirements at lower flow and face velocities.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate various embodiments of the present invention. The drawings and description together serve to fully explain embodiments of the present invention.

DETAILED DESCRIPTION

Figure 1:
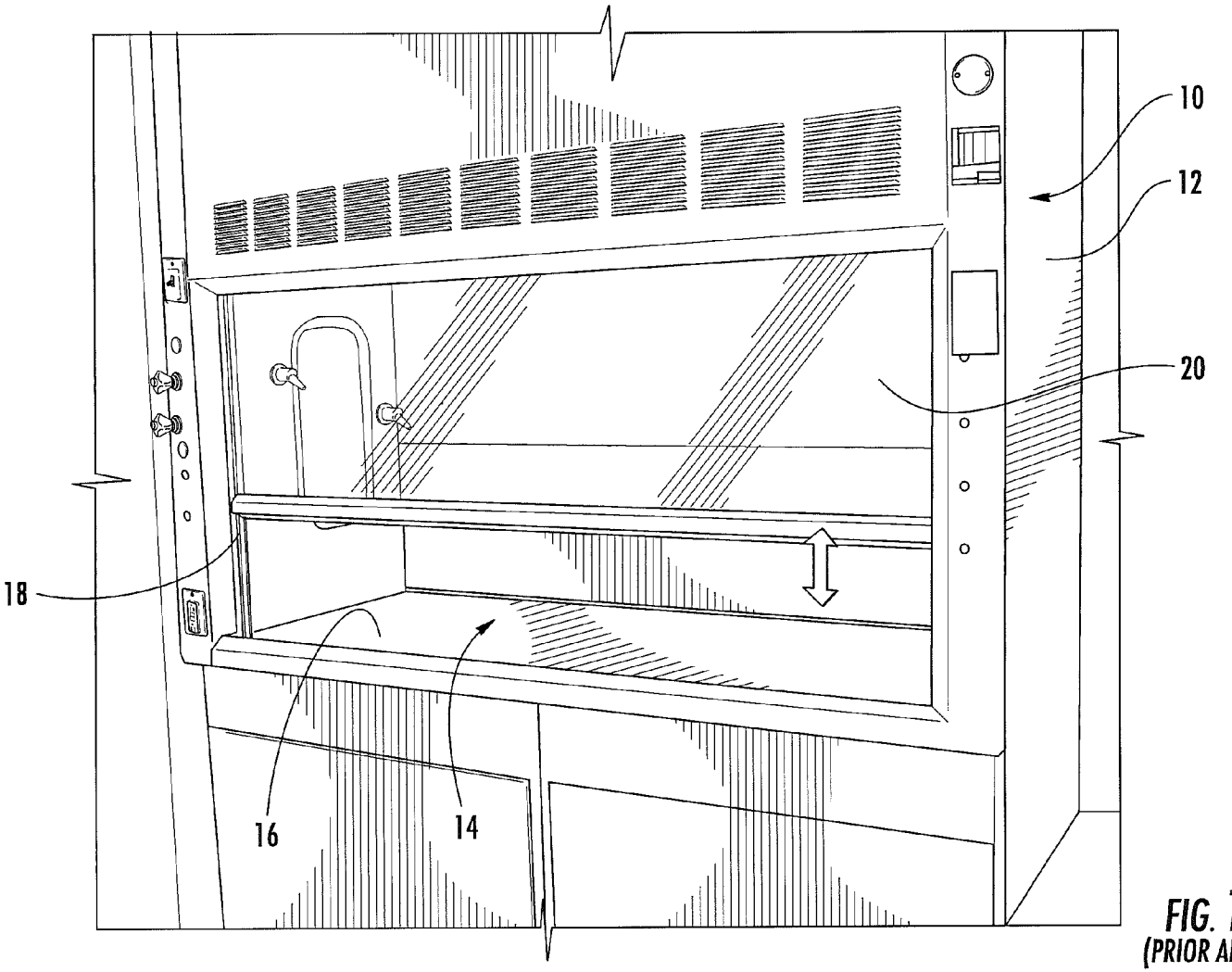
FIG. 1 (PRIOR ART)
FIG. 1 is a perspective view of a conventional fume hood.

The present invention will now be described more fully hereinafter with reference to the accompanying figures, in which embodiments of the invention are shown. This invention may, however, be embodied in many different forms and should not be construed as limited to the embodiments set forth herein. In the figures, certain features or elements may be exaggerated for clarity, and broken lines, if present, may illustrate optional features or operations unless specified otherwise. Features described with respect to one figure or embodiment can be associated with another embodiment or figure although not specifically described or shown as such.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that although the terms first and second are used herein to describe various features/elements, these features/elements should not be limited by these terms. These terms are only used to distinguish one feature/element from another feature/element. Thus, a first feature/element discussed below could be termed a second feature/element, and similarly, a second feature/element discussed below could be termed a first feature/element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

Figure 2:
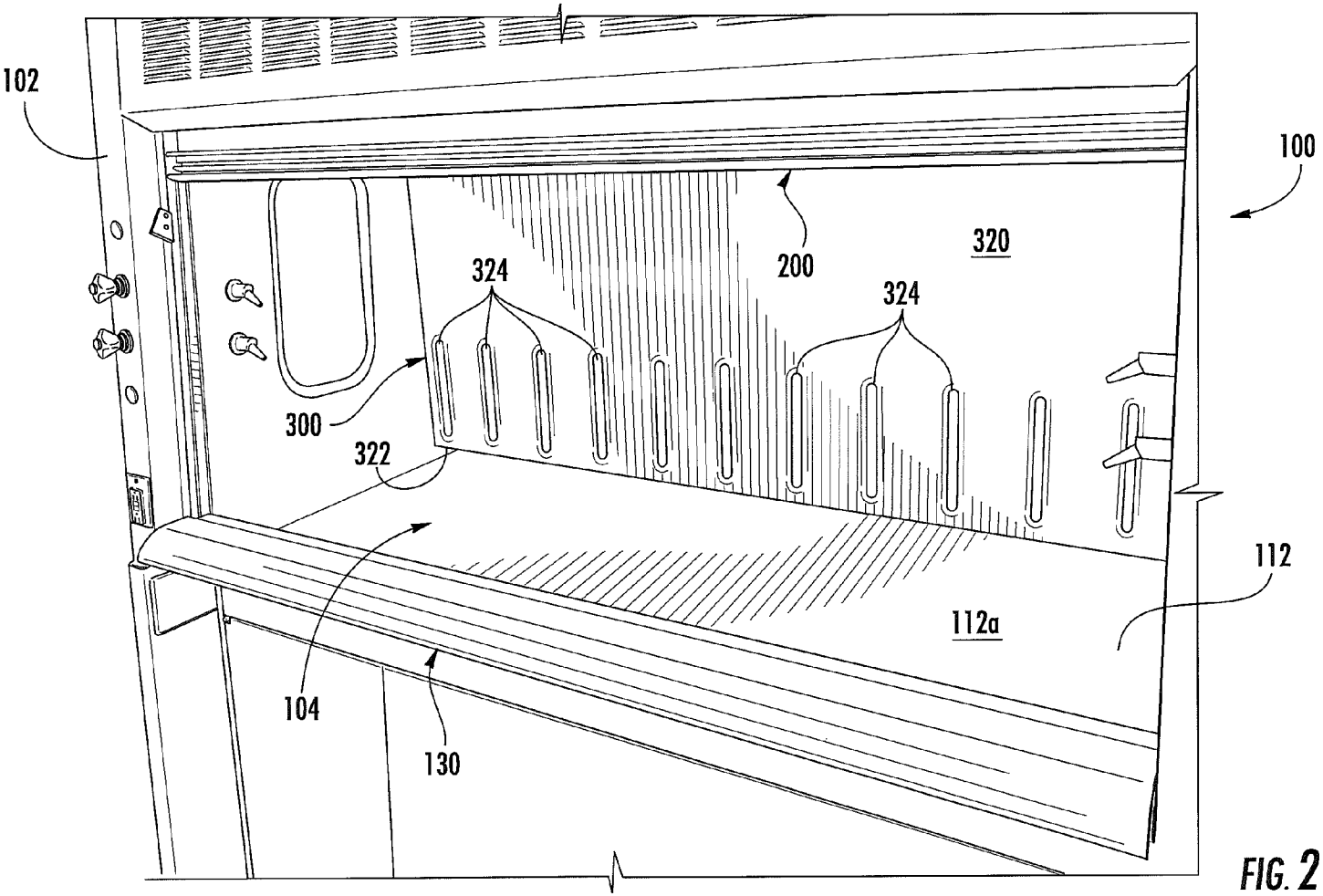
FIG. 2 is a perspective view of a fume hood according to some embodiments of the present invention.
Figure 3:
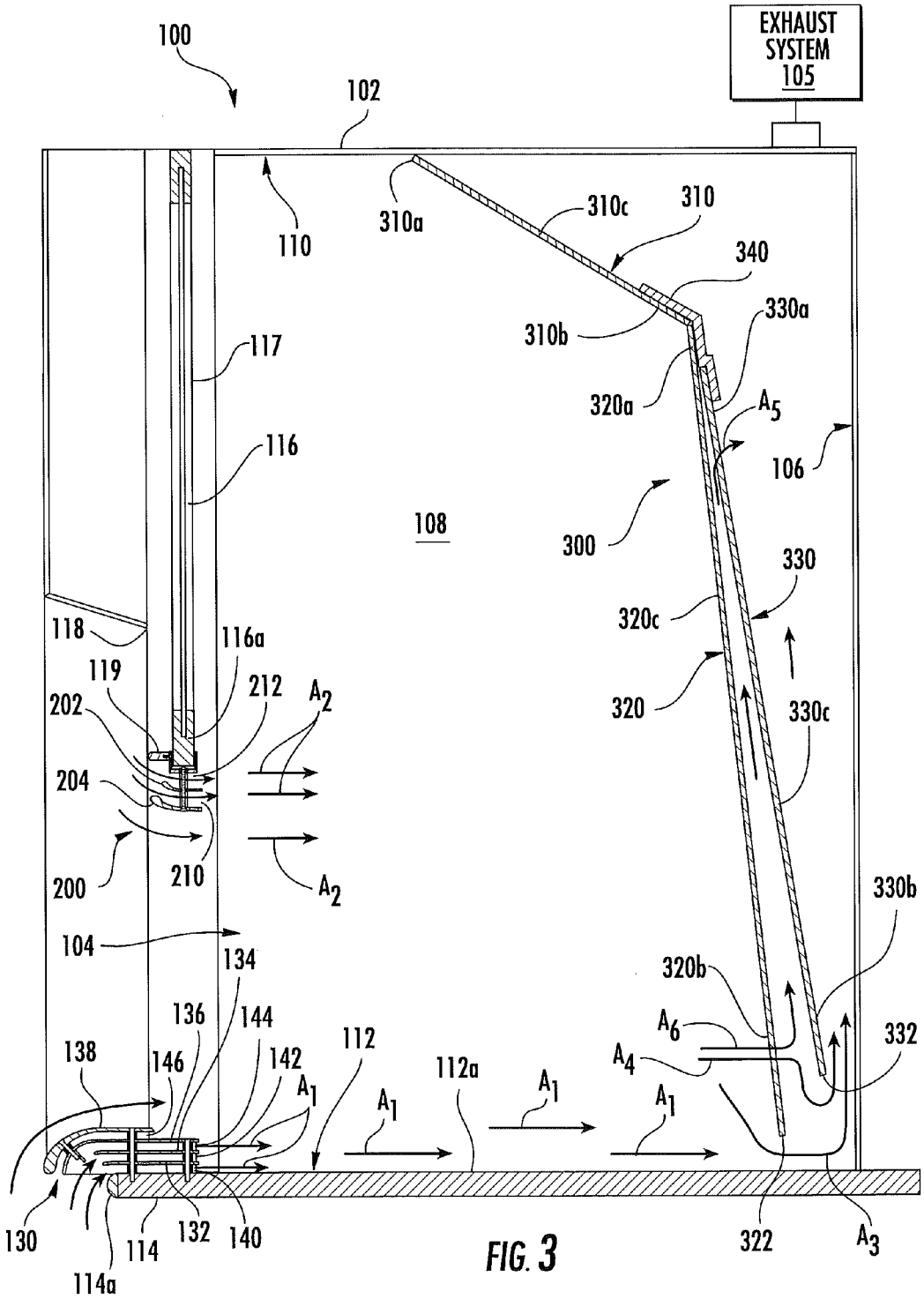
FIG. 3 is a side, cross sectional view of a fume hood illustrating an elongated airfoil assembly attached to the floor edge portion of the fume hood, an elongated airfoil assembly attached to the lower edge portion of the sash of the fume hood, and a baffle assembly located in front of the rear wall of the fume hood, according to some embodiments of the present invention.
Figure 4:
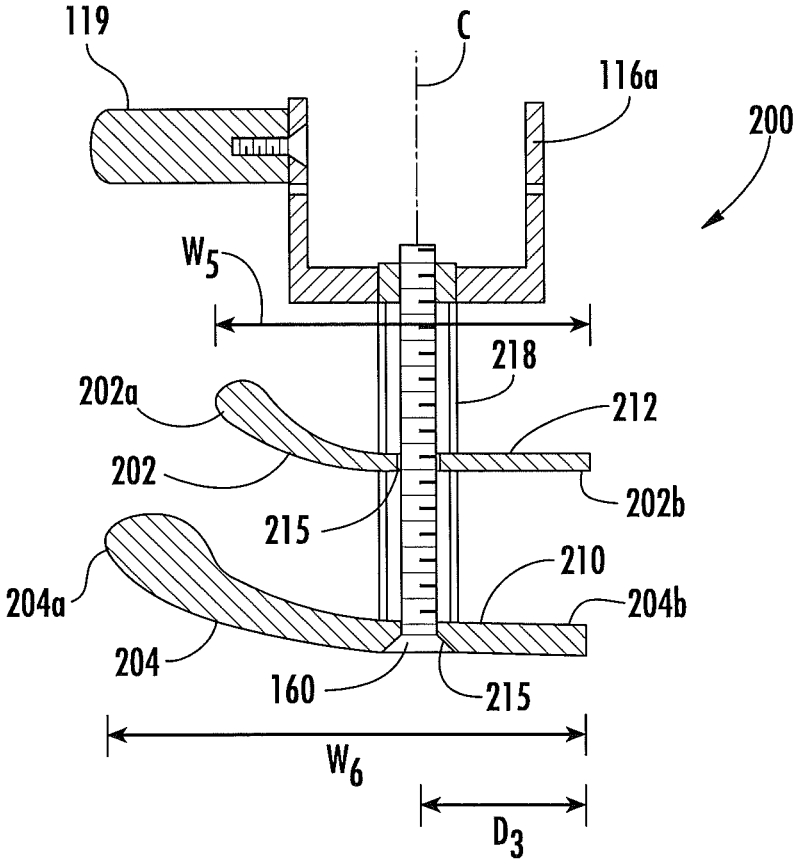
FIG. 4 is an enlarged side, cross-sectional view of the elongated airfoil assembly attached to the lower edge portion of the sash of the fume hood of FIG. 3.

Referring now to FIGS. 2-3, a fume hood 100 that reduces the amount of air required to flow therein, according to some embodiments of the present invention, is illustrated. The illustrated fume hood 100 includes a cabinet 102 having a ventilated work chamber 104 (i.e., the chamber 104 is in communication with an exhaust system 105). The chamber 104 has a rear wall 106, side walls 108, a ceiling 110, a floor 112 on which work is performed within the chamber 104 and an access opening 118 at the front of the chamber 104. A sash 116 is slidably mounted to the chamber 104 at the access opening 118 and is movable between raised and lowered positions. The sash 116 consists primarily of a clear panel 117 formed of glass or any other desired material so that users of the fume hood 100 can see into the chamber 104 through the clear panel 117. The sash 116 may also include a handle 119, as shown in FIGS. 2 and 4, for moving the sash 116 up and down in its vertical plane of movement.

The fume hood 100 includes airfoil assemblies 130, 200 and a baffle assembly 300 that are designed to reduce the amount of air flow required to be pulled into the chamber for the fume hood to operate safely. The airfoil assemblies 130, 200 and baffle assembly 300 are described below.

The illustrated fume hood 100 is connected to an exhaust system 105. As would be understood by those skilled in the art of the present invention, the exhaust system 105 consists of a conduit and a blower that draw air (and contaminants) outwardly from the chamber 104 and transport the air away from the fume hood 100 to a safe location. As used herein, the term "ventilated chamber" means a fume hood chamber that is adapted to be connected to an exhaust system.

As illustrated in FIG. 3, an edge portion 114 of the work space floor 112 extends outwardly to the access opening 118, and an elongated airfoil assembly 130 is attached to the floor edge portion 114. The airfoil assembly 130 extends substantially the entire span of the access opening, as illustrated in FIG. 2. The airfoil assembly 130 has a low profile such that it does not hinder use of the fume hood 100 and does not form a barrier to the movement of objects into and out of the chamber 104.

The airfoil assembly 130 includes a plurality of elongated vanes 132-138 arranged in vertically spaced-apart relationship to define a plurality of vertically spaced-apart air flow channels 140-146. The air flow channels 140-146 extend into the chamber 104 through the access opening 118 and are substantially parallel with the surface 112*a* of the floor 112. When flow is drawn from the chamber 104 by the exhaust system 105, the airfoil assembly 130 produces controlled air flow patterns (indicated by arrows $A_1$) that sweep along the floor surface 112*a*. These controlled air flow patterns $A_1$ prevent the accumulation of contaminants at the floor surface 112*a* and also prevent the formation of eddies or vortexes within the chamber and particularly at the access opening 118 which, in conventional fume hoods, can cause noxious contaminants to escape from the chamber 104. Because of the controlled air flow patterns $A_1$ created by the airfoil assembly 130, the amount of air flow required for safe operation of the fume hood 100 can be substantially reduced.

Referring to FIGS. 5 and 6A-6E, the airfoil assembly 130 will be described in greater detail. The illustrated airfoil assembly 130 includes first, second, third, and fourth vanes 132, 134, 136, 138. Each elongated vane 132-138 has a respective downwardly curved leading edge portion 132*a*,

134*a*, 136*a*, 138*a* and a respective planar trailing edge portion 132*b*, 134*b*, 136*b*, 138*b*. The vanes 132-138 are arranged in a staggered configuration relative to the free end 114*a* of the floor edge portion 114. The leading edge portion 138*a* of the fourth vane 138 extends furthest from the free end 114*a* of the floor edge portion 114, followed by the leading edge portion 136*a* of the third vane 136, followed by the leading edge portion 134*a* of the second vane 134, and finally by the leading edge portion 132*a* of the first vane 132, as illustrated.

Figure 5:
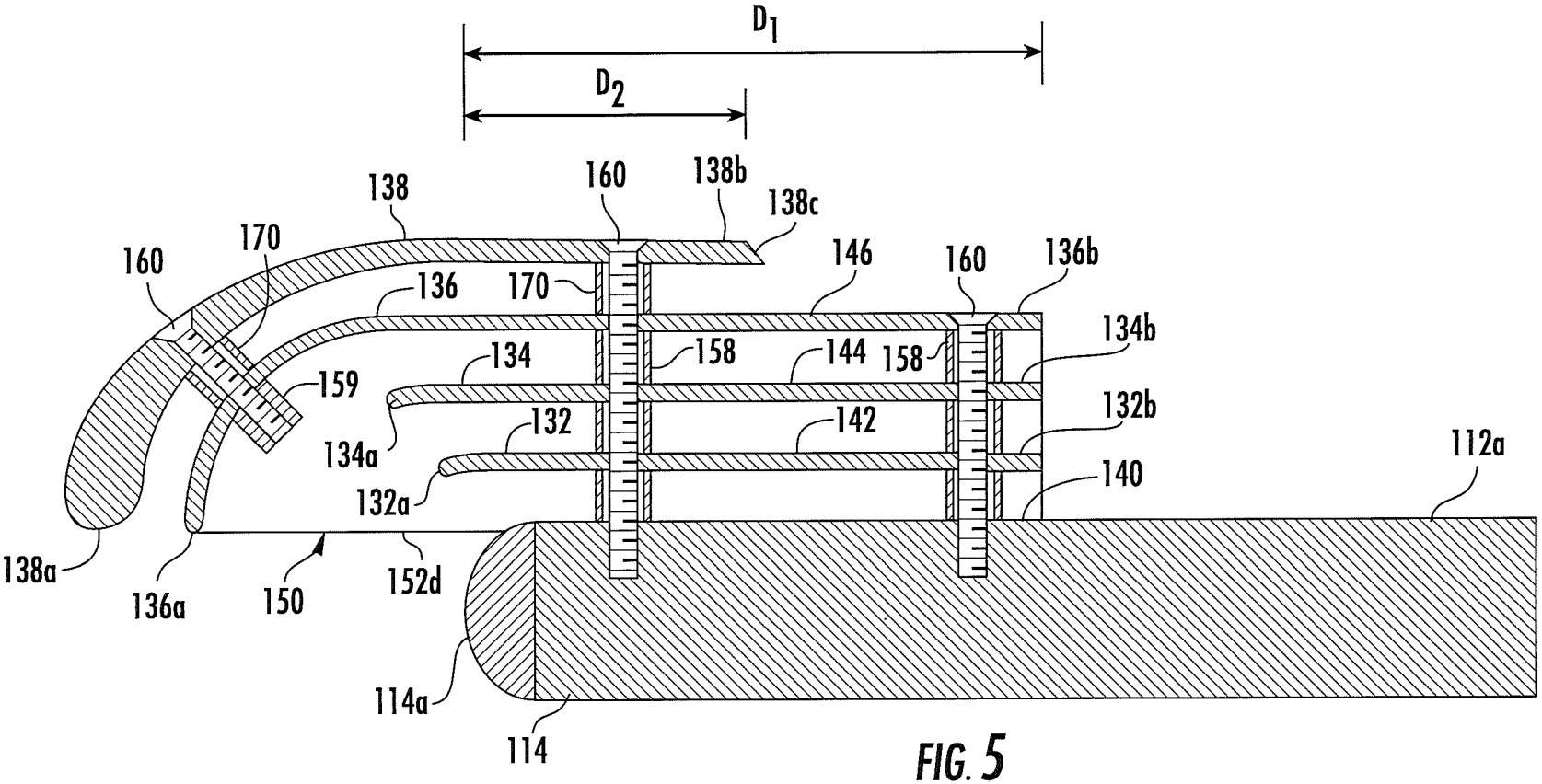
FIG. 5 is an enlarged side, cross-sectional view of the elongated airfoil assembly attached to the floor edge portion of the fume hood of FIG. 3.

The trailing edge portions 132*b*, 134*b*, 136*b*, 138*b* of the vanes 132-138, when in an installed configuration, are substantially parallel with each other and with the floor surface 112*a* of the fume hood 100, as illustrated in FIG. 5. In the illustrated embodiment, the first, second and third vanes 132, 134, 136 have respective trailing edges 132*b*, 134*b*, 136*b* that terminate the same distance $D_1$ from a free end 114*a* of the floor edge portion 114. The fourth vane 138 has a trailing edge 138 that terminates at a location closer to the free end 114*a* of the floor edge portion 114 than the trailing edge portions 132*b*-136*b* of the first, second, and third vanes 132-136. The distance between the free end 114*a* of the floor edge portion 114 and the location where the fourth vane trailing edge portion 138*b* terminates is indicated as $D_2$.

In the illustrated embodiment, the first, second and third vanes 132-136 have respective first, second, and third widths $W_1$, $W_2$, $W_3$ (i.e., the distance from the leading edge to the trailing edge), as illustrated. The width $W_2$ of the second vane 134 is greater than the width $W_1$ of the first vane 132, and the width $W_3$ of the third vane 136 is greater than the width $W_2$ of the second vane 134. The thickness of the first, second, and third vanes 132-136 is substantially constant along the respective widths $W_1$, $W_2$, $W_3$ thereof. However, this is not a requirement.

In the illustrated embodiment, the leading edge portions 132*a*, 134*a* of the first and second vanes 132, 134 have a slight downwardly curved configuration compared with the downwardly curved configuration of the leading edges 136*a*, 138*a* of the third and fourth vanes 136, 138. For example, the first and second vane leading edge portions 132*a*, 134*a* each have a radius of curvature of between about one degree and about twenty degrees (1°-20°), and the third and fourth vane leading edge portions 136*a*, 138*a* each have a radius of curvature of between about seventy degrees and about ninety degrees (70°-90°).

In the illustrated embodiment, the fourth vane 138 has a cross-sectional shape of an airfoil with a generally blunt leading edge portion 138*a* that tapers to a trailing edge portion 138*b*. The trailing edge portion 138*b* of the fourth vane terminates at an edge 138*c* with a beveled configuration, as illustrated. The fourth vane 138 has a width $W_4$ that is less than the width $W_3$ of the third vane 136, as illustrated. The first, second and fourth vanes 132, 134, 138 include a pair of spaced-apart apertures 131, as illustrated, that are configured to receive a respective fastener 160 therethrough when the airfoil assembly 130 is attached to the floor leading edge portion 114. The third vane 136 has three spaced-apart apertures 131, as illustrated, that are configured to receive a respective fastener 160 therethrough when the airfoil assembly 130 is attached to the floor leading edge portion 114.

Figure 6A:
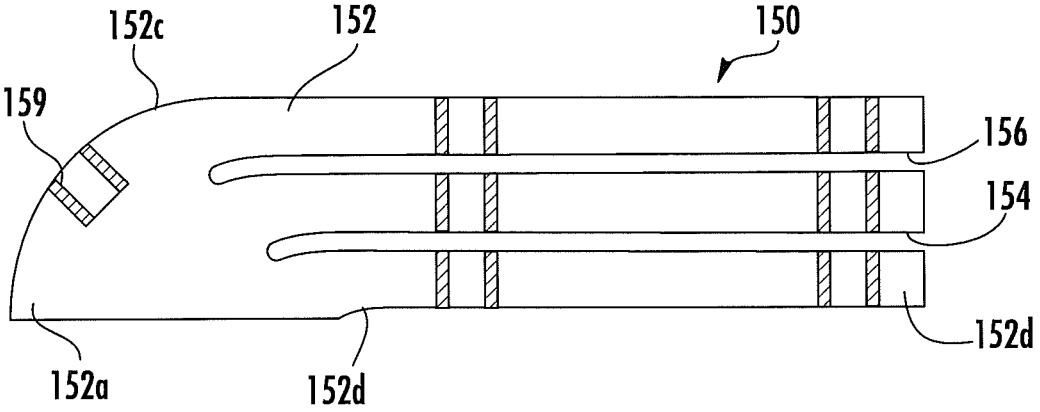
FIG. 6A is a side view of a support member for the elongated airfoil assembly of FIG. 5, according to some embodiments of the present invention.
Figure 6B:
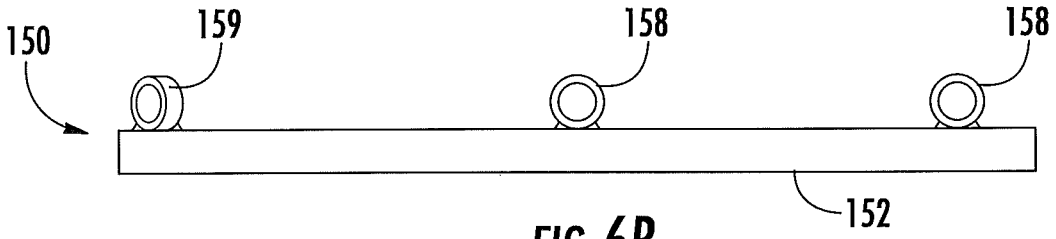
FIGS. 6B-6C are top plan views of support members for the elongated airfoil assembly of FIG. 5, according to some embodiments of the present invention.
Figure 6C:
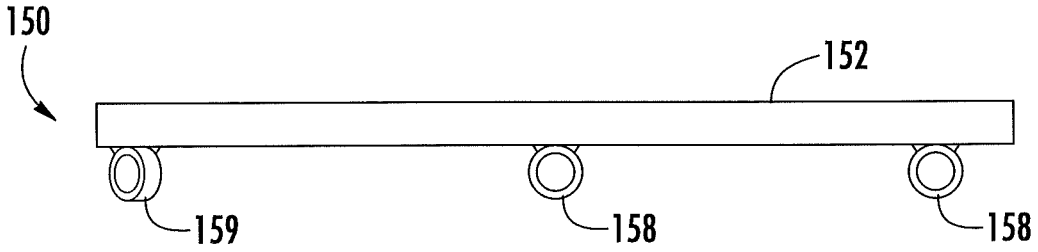
Figure 6D:
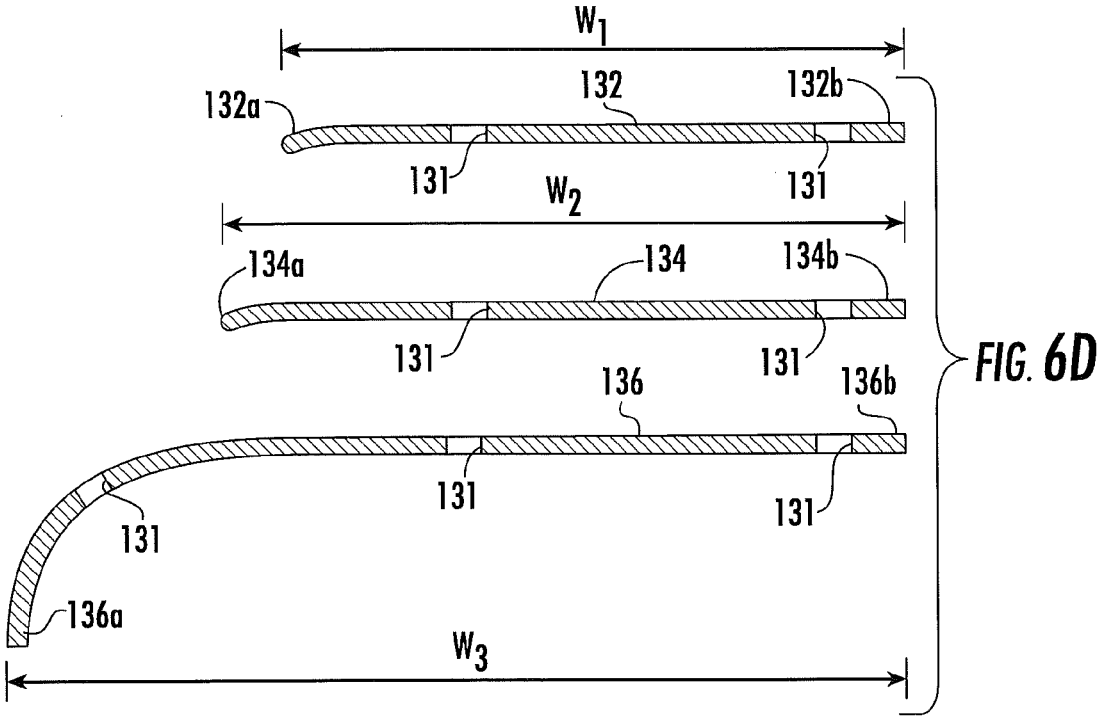
FIG. 6D is a side, cross-sectional view of the first, second and third elongated vanes of the airfoil assembly of FIG. 5, according to some embodiments of the present invention.

The first, second, third, and fourth elongated vanes 132-138 are secured to the floor edge portion 114 via a pair of supports 150 that are secured to the floor edge portion 114 in spaced-apart relationship. FIG. 6A is a side view of one of the support members 150, and FIGS. 6B and 6C are respective top views of both of the support members 150. Each support member 150 includes a substantially planar web member 152 having opposite leading and trailing edge portions 152*a*, 152*b*, and opposite upper and lower edges 152*c*, 152*d*. Upper edge 152*c* has a contour that matches the contour of the third vane 136. As illustrated in FIG. 5, the third vane 136, when in an installed configuration, is in contacting relationship with the web member upper edge 152*c*. The web member lower edge 152*d* has a contour that matches the contour of the floor edge portion 114. As illustrated in FIG. 5, the web member lower edge 152*d*, is in contacting relationship with the floor edge portion 114 when the support 150 is secured to the floor edge portion 114.

The web member 152 includes a pair of slots 154, 156 formed therein that terminate at the web member trailing edge portion 152*b*. The slots 154, 156 are substantially parallel and are in adjacent, vertically spaced-apart relationship. Slot 154 has a contour that matches the contour of the first vane 132, and slot 156 has a contour that matches the contour of the second vane 134. The first and second elongated vanes 132, 134 are slidably secured with the respective slots 154, 156 when in an installed configuration, as illustrated in FIG. 5.

The web member 152 also includes a plurality of fastener rings 158 extending outwardly from a respective side thereof. The fastener rings 158 are configured to receive fasteners therethrough that secure the support member 150 and the first, second and third vanes 132, 134, 136 to the floor edge portion 114. When assembled, the apertures 131 in the first, second, and third vanes 132, 134, 136 align with the respective fastener rings 158 and a fastener 160, such as, for example, a bolt, screw, or other threaded member, is inserted therethrough to secure the airfoil assembly 130 to the floor leading edge portion 114.

Figure 6E:
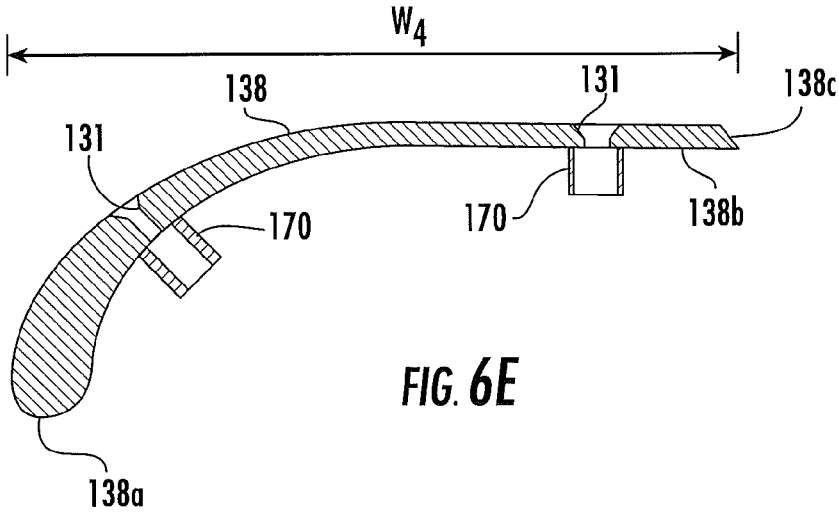
FIG. 6E is a side, cross-sectional view of the fourth elongated vane of the airfoil assembly of FIG. 5, according to some embodiments of the present invention.

The web member 152 also includes a threaded boss 159 at the leading edge 152*a* thereof that is utilized for securing the fourth vane 138 to the web member 152. The first, second, and third vanes 132, 134, 136 are maintained in vertically spaced-apart relationship via the web member. For example, the first and second vanes 132, 134 are engaged with slots 154, 156, and the third vane 136 is in contacting relationship with the upper edge 152*c* of the web member 152. The fourth vane is maintained in spaced-apart relationship with respect to the third vane 136 via a pair of spacers 170 extending outwardly from the fourth vane lower surface 138*d*, as illustrated in FIG. 6E. Each spacer 170 is aligned with a respective aperture 131, as illustrated. When installed, a fastener 160 secures the fourth vane to the threaded boss 159 in the web member 152. Another fastener 160 extends through respective apertures 131 in the first, second, third and fourth vanes and through a ring member 158 and is threadingly engaged with threads in the floor leading edge portion 114.

The components of the airfoil assembly 130 may be formed from various materials that are suitable for use in a fume hood environment. For example, the vanes 132-138 and web member 152, as well as fasteners 160, may be formed from metallic materials, polymeric materials, or some combination of metallic and polymeric materials. Exemplary materials for these components may include, but are not limited to, stainless steel Type 316 or Type 304; fiberglass reinforced polyester (FRP); and painted carbon steel.

Airfoil assembly 130 may have different numbers of vanes and vanes with different configurations than illustrated. For example, in some embodiments, fewer than four vanes may be used (e.g., 3 vanes or 2 vanes). In some embodiments the leading edge of the fourth vane 138 may not have a generally blunt leading edge portion 138*a*.

Referring back to FIGS. 2-4, another elongated airfoil assembly 200 is attached to a lower edge portion 116*a* of the sash 116. The airfoil assembly 200 extends substantially an entire span of the sash 116, as illustrated in FIG. 2. The airfoil assembly 200 includes first and second elongated vanes 202, 204 in vertically spaced-apart relationship that define an air flow channels 210, 212 that extend into the chamber 104 through the access opening 118. When airflow is created within the chamber 104 by the exhaust system 105, the airfoil assembly 200 produces controlled air flow patterns (indicated by arrows $A_2$) via the channels 210, 212 that flow into the chamber 104. These controlled air flow patterns $A_2$ prevent the formation of eddies or vortexes in the chamber and particularly at the access opening 118 adjacent to the sash 116 which, in conventional fume hoods, can cause noxious contaminants to escape from the chamber 104. Because of the controlled air flow patterns $A_2$ created by the air foil assembly 200, the amount of air flow required for safe operation of the fume hood 100 can be substantially reduced.

The airfoil assembly 200 has a low profile and does not interfere with operation of the sash 116 or with the sash handle 119. Moreover, the airfoil, assembly 200 is configured such that, when the sash 116 is fully closed, the sash handle 119 mates with the airfoil assembly 130 attached to the floor edge portion 114.

Referring to FIG. 4, the airfoil assembly 200 will be described in greater detail. The first and second vanes 202, 204 of the airfoil assembly 200 each have a cross-sectional shape of an airfoil with a generally blunt leading edge portion 202*a*, 204*a* that tapers to a generally planar trailing edge portion 202*b*, 204*b*. The leading edge portions 202*a*, 204*a* are upwardly curved, as illustrated. In the illustrated embodiment, the first and second vanes 202, 204 have respective first and second widths $W_5$, $W_6$ (i.e., the distance from the leading edge to the trailing edge), wherein the width $W_6$ of the second vane 204 is greater than the width $W_5$ of the first vane 202.

In the illustrated embodiment, the first and second vanes 202, 204 each have a trailing edge 202*b*, 204*b* that terminates at a location the same distance from a centerline C of the sash (indicated by $D_3$). Also, the first vane 202 has a leading edge portion 202*a* that is located closer to the centerline C of the sash than the leading edge portion 204*a* of the second vane 204, as illustrated.

The first and second vanes 202, 204 have a plurality of apertures 215 formed therethrough in spaced-apart relationship. When the airfoil assembly 200 is installed, apertures in the first and second vanes 202, 204 align with a respective support member 218 and a fastener 160 extends therethrough to secure the airfoil assembly to the sash end portion 116*a*. In some embodiments of the present invention, the number of apertures and support members may be dependent on the opening width of the fume hood chamber. The number of support members and subsequent apertures may be calculated, for example, by the formula: No. of Support Members=(Nominal Hood Width)−1. For example, for a hood having a width of 4 feet, the number of support members will be 3 (i.e., 4-1). Similarly, for a hood having a width of 6 feet, the number of support members will be 5 (i.e., 6-1). In some embodiments of the present invention, the number of apertures may be calculated, for example, by the formula: No. Apertures=No. Support Members+2. The size of the apertures can be determined by equally spacing the support members across the effective width of the fume hood opening.

The various components of the airfoil assembly 200 may be formed from various materials that are suitable for use in a fume hood environment. For example, the vanes 202, 204, support member(s) 218, and fasteners 106 may be formed from metallic materials, polymeric materials, or some combination of metallic and polymeric materials. Exemplary materials include, but are not limited to, stainless steel (e.g., Type 316, Type 304 etc.); fiberglass reinforced polyester (FRP); and painted carbon steel. In some embodiments, the support member 218 is a tubular spacer placed between vanes with an inside diameter sufficient to accept the insertion of fastener 160.

Airfoil assembly 200 may have different numbers of vanes and may have vanes with different configurations than illustrated. For example, in some embodiments, more than two vanes may be used (e.g., 3 vanes). In some embodiments, one or more of the first and second vanes 202, 204 may not have a generally blunt leading edge portion.

Figure 7:
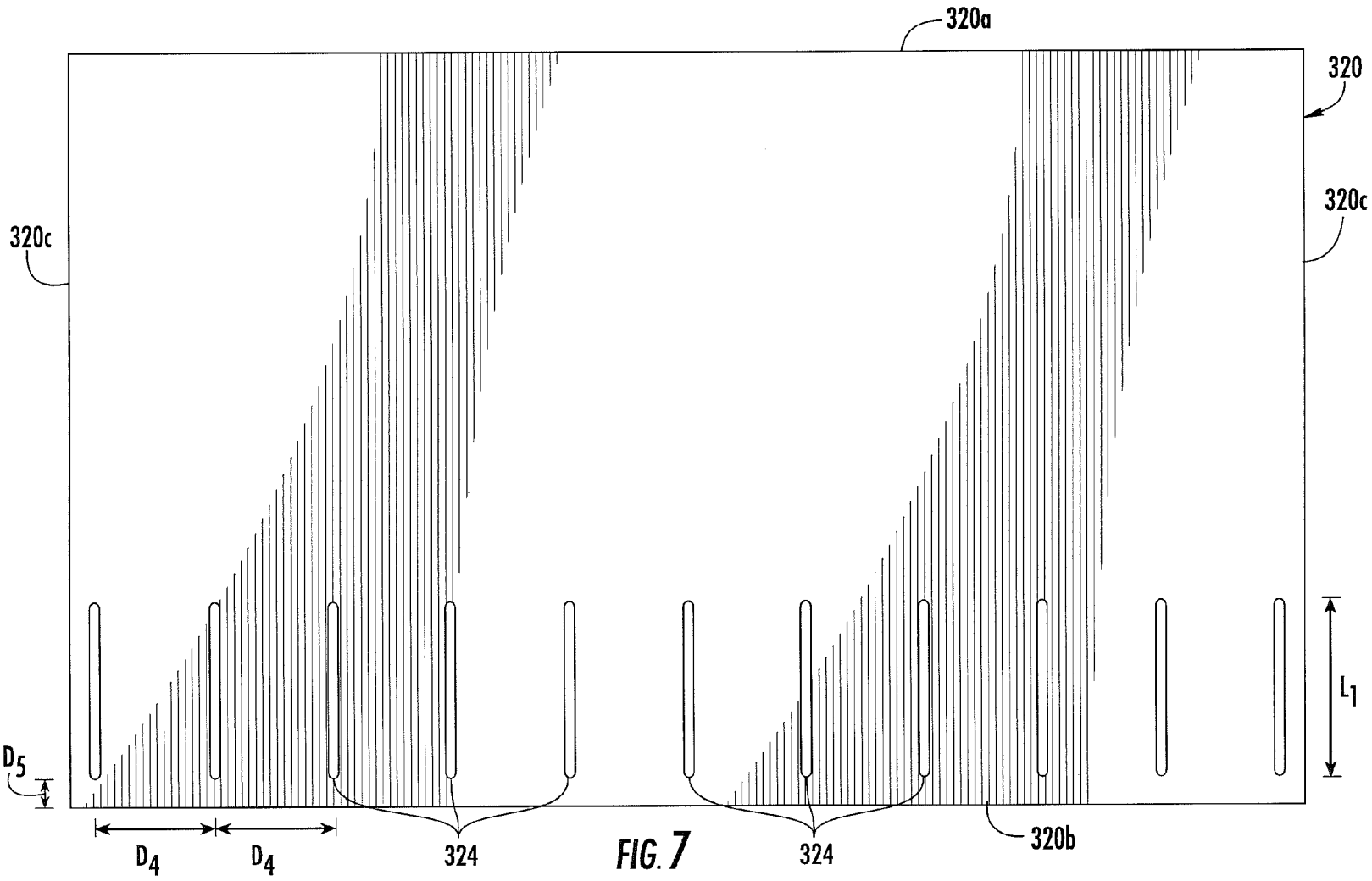
FIG. 7 is a front elevation view of the primary baffle panel of the baffle assembly illustrated in FIG. 3, according to some embodiments of the present invention.
Figure 8:
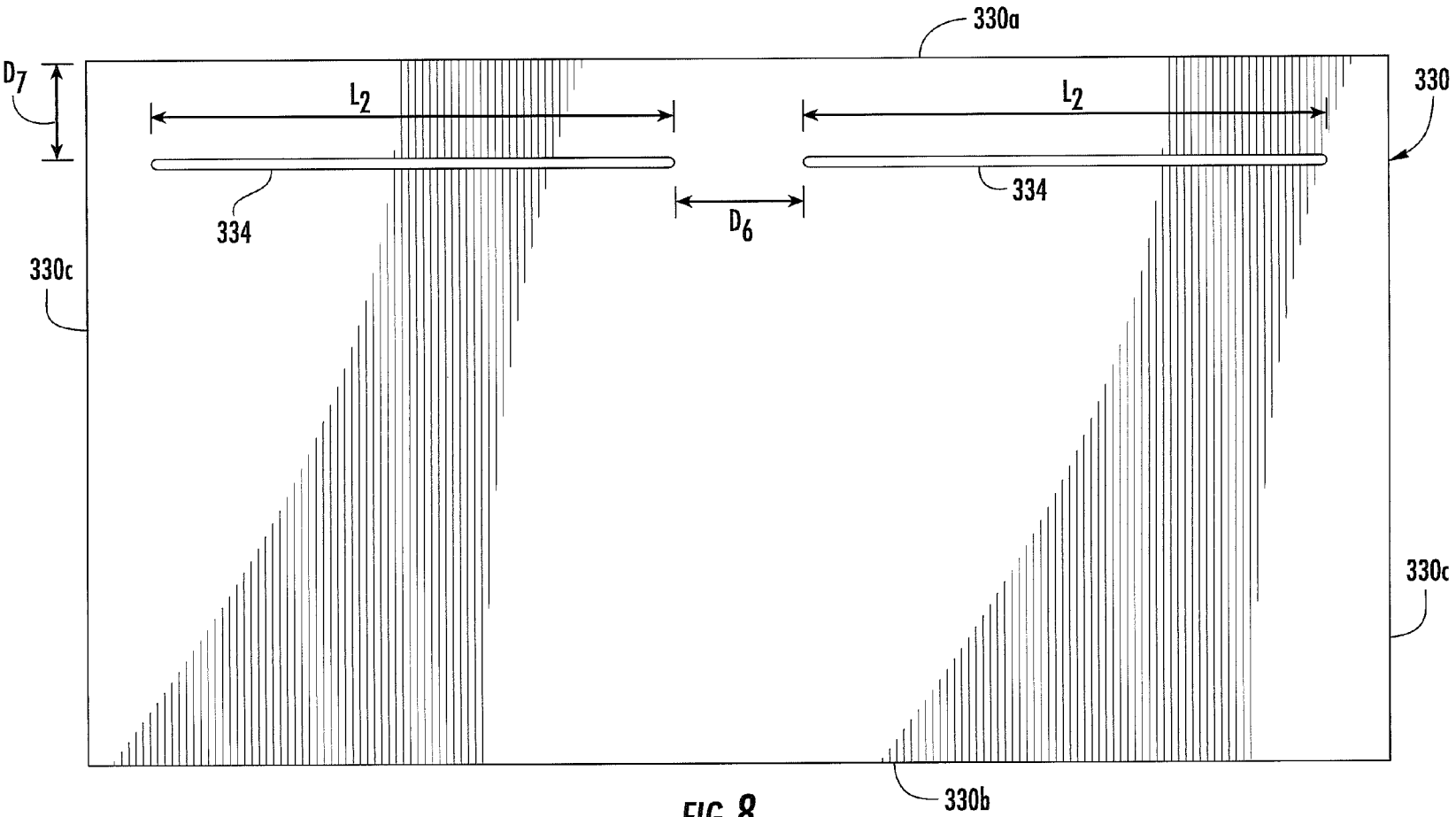
FIG. 8 is a front elevation view of the buffering baffle panel of the baffle assembly illustrated in FIG. 3, according to some embodiments of the present invention.

Referring to FIGS. 2 and 7-8, the baffle assembly 300 is located in front of, and spaced-apart from, the chamber rear wall 106. The illustrated baffle assembly 300 includes an upper panel 310, a primary panel 320, and a buffering panel 330. The upper panel 310 has a generally rectangular shape and includes opposite upper and lower end portions 310*a*, 310*b* and opposite side edges 310*c*. The upper end portion 310*a* is attached to the chamber ceiling 110 and the lower end portion is attached to an upper portion 320*a* of the primary panel 320 via bracket 340. The upper panel side edges 310*c* are attached to the respective chamber side walls 108. The upper panel 310 can be attached to the ceiling 110 and side walls 108 of the chamber 104 in various ways. For example, in some embodiments, angle brackets may be utilized, as would be understood by those skilled in the art of the present invention.

The primary panel 320 has a generally rectangular shape with opposite upper and lower end portions 320*a*, 320*b* and opposite side edges 320*c*. The primary panel 320 side edges 320*c* are attached to the respective chamber side walls 108 and the lower end portion 320*b* is spaced apart from the chamber floor 112, for example, between about one inch and about three inches (1"-3"), to provide a generally horizontal air-exit slot 322 along the width of the chamber 104 that allows air to flow into the exhaust system 105 connected to the fume hood 100.

The primary panel 320 also includes a plurality of generally vertical air-exit slots 324 adjacent the lower end portion 320*b* and arranged in horizontal spaced-apart relationship, as illustrated in FIG. 7. In some embodiments, each air-exit slot 324 has a length $L_1$ of between about six inches and twelve inches (6"-12"), and a distance $D_4$ between adjacent air-exit slots 324 may be between about four inches and eight inches (4"-8"). In the illustrated embodiment, the air-exit slots 324 are located a distance $D_5$ of between about one inch and about three inches (1"-3") from the lower end portion 320*b*. The illustrated air-exit slots 324 are straight with a width of about one-half inch (0.50"). However, other widths, as well as other configurations, may be possible.

The distance between vertical slots, the heights of the vertical slots, and the number of vertical slots may be dependent on the aspect ratio of the fume hood interior. As the fume hood chamber becomes wider, additional slots may be required. As the fume hood chamber becomes taller, higher vertical slots may be required. The number of vertical slots can be calculated using the following formula: No. of slots=(Interior Width/6)+1. For example, the number of vertical slots for a hood having an interior width of 62" would be 11 (e.g., No. Slots=(62/6)+1=10+1=11). The resultant quotient is rounded to the nearest whole number. The height of a vertical slot can be calculated by dividing the height of the primary baffle by 4. For example, if the height of a primary baffle is 36", a vertical slot height would be 9" (e.g., 36/4=9).

The buffering panel 330 has a generally rectangular shape with opposite upper and lower end portions 330*a*, 330*b* and opposite side edges 330*c*. In the illustrated embodiment, the upper end portion 330*a* is attached to the primary panel upper end portion 320*a* via bracket 340, and the buffering panel 330 side edges 330*c* are attached to the respective chamber side walls 108. The buffering panel 330 is angled away from the primary panel 320, as illustrated, such that the buffering panel lower end portion 330*b* is spaced apart from the chamber floor 112, for example, between about two inches and about six inches (2"-6"), to provide a generally horizontal air-exit slot 332 along the width of the chamber 104 that allows air to flow into an exhaust system connected to the fume hood 100.

The buffering panel 330 also includes a pair of generally horizontal air-exit slots 334 adjacent the upper portion 330*a* thereof and arranged in horizontal spaced-apart relationship, as illustrated. In some embodiments, each buffering panel air-exit slot 334 has a length $L_2$ of between about fifteen inches and thirty inches (15"-30"), and a distance $D_6$ between the air-exit slots 334 is between about four inches and eight inches (4"-8"). In the illustrated embodiment, the air-exit slots 334 are located a distance $D_7$ of between about three inches and about 6ix inches (3"-6") from the upper portion 330*a*. The illustrated air-exit slots 334 are straight with a width of about one-half inch (0.50"). However, other widths, as well as other configurations, may be possible. The width of the upper, primary and buffering baffles is determined by the interior width of the fume hood chamber. As such, the width of the horizontal slots in the buffering panel may vary based on the fume hood chamber width. To ensure structural strength of the buffering baffle, additional slots can be added for hoods with interior widths greater than about 65".

As illustrated in FIG. 3, air flowing into the chamber 104 has several flow paths through and under the baffle assembly to reach the exhaust system 105. Air flows under the slots 322, 332 (indicated by arrow $A_3$ in FIG. 3) and up and out through the exhaust system 105. Some of the air flowing through air exit slots 324 adjacent the lower end portion 320*b* of the primary panel 320 flows upward (indicated by arrow $A_6$ in FIG. 3) and some of the air flows downward and underneath the bottom of the buffering panel 330 (indicated by arrow $A_4$ in FIG. 3). The air flowing upwards passes through the buffering panel air-exit slots 334 (indicated by arrow $A_5$ in FIG. 3).

The combination of airfoil assemblies 130, 200 and the baffle assembly 300, according to embodiments of the present invention, allows the air flow required for safe operation of a fume hood 100 to be reduced substantially below conventional flow rates. In some embodiments, face velocities can be reduced to 60 to 70 fpm.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A fume hood adapted to be connected to an exhaust system, the fume hood comprising:

a ventilated chamber having an access opening and a work space floor, wherein an edge portion of the floor extends outwardly to the access opening; and an elongated airfoil assembly attached to the floor edge portion, wherein the airfoil assembly extends substantially the entire span of the access opening and comprises at least three elongated vanes that extend over a portion of the floor in vertically spaced-apart relationship that define a plurality of vertically spaced-apart air flow channels, wherein the at least three vanes have respective planar trailing edge portions that are parallel with each other and with a surface of the work space floor, wherein the air flow channels extend into the chamber through the access opening and are substantially parallel with the floor surface, wherein air flow created within the chamber by the exhaust system causes the airfoil assembly to produce controlled air flow patterns that sweep along the floor surface.

2. The fume hood of claim 1, wherein each vane includes a downwardly curved leading edge portion.

3. The fume hood of claim 2, wherein the airfoil assembly comprises first, second, third and fourth vanes, wherein the first, second and third vanes have respective trailing edges that are each located a first distance from a free end of the floor edge portion, wherein the fourth vane has a trailing edge that is located a second distance from the free end of the floor edge portion, wherein the second distance is less than the first distance.

4. The fume hood of claim 3, wherein the first, second and third vanes have respective first, second, and third widths, wherein the second width is greater than the first width, and wherein the third width is greater than the second width.

5. The fume hood of claim 4, wherein the first and second vane leading edge portions each have a radius of curvature relative to the respective first and second vane trailing edge portions of between about one degree and about twenty degrees (1°-20°), wherein the third and fourth vane leading edge portions each have a radius of curvature relative to the respective third and fourth vane trailing edge portions of between about seventy degrees and about ninety degrees (70°-90°).

6. The fume hood of claim 3, wherein the fourth vane trailing edge has a beveled configuration.

7. The fume hood of claim 2, wherein a thickness of the first, second, and third vanes is substantially constant along a width thereof, and wherein the fourth vane has a cross-sectional shape of an airfoil with a generally blunt leading edge portion that tapers to a trailing edge portion.

8. A fume hood adapted to be connected to an exhaust system, the fume hood comprising:

a ventilated chamber having an access opening;

a sash slidably mounted to the chamber at the access opening and movable between raised and lowered positions; and an elongated airfoil assembly attached to a lower edge portion of the sash, wherein the airfoil assembly extends substantially an entire span of the sash and comprises first and second elongated vanes in vertically spaced-apart relationship that define an air flow channel that extends into the chamber through the access opening, wherein the first and second vanes each have an upwardly curved free leading edge portion and a planar free trailing edge portion that is substantially parallel with a floor of the chamber, wherein air flow created within the chamber by the exhaust system causes the airfoil assembly to produce controlled air flow patterns into the chamber.

9. The fume hood of claim 8, wherein the first and second vanes have respective first and second widths, wherein the second width is greater than the first width.

10. The fume hood of claim 9, wherein the free trailing edge portions of the first and second vanes are each located the same distance from a centerline of the sash.

11. The fume hood of claim 9, wherein the first vane free leading edge is located a first distance from a centerline of the sash, wherein the second vane free leading edge is located a second distance from a centerline of the sash, and wherein the second distance is greater than the first distance.

12. The fume hood of claim 8, wherein the first and second vanes each have a cross-sectional shape of an airfoil with a generally blunt leading edge portion that tapers to a trailing edge portion.

13. A fume hood adapted to be connected to an exhaust system, the fume hood comprising:

a ventilated chamber having an access opening and a work space floor, wherein an edge portion of the floor extends outwardly to the access opening;

a first elongated airfoil assembly attached to the floor edge portion, wherein the first airfoil assembly extends substantially an entire span of the access opening and comprises at least three elongated vanes that extend over a portion of the floor in vertically spaced-apart relationship that define a plurality of vertically spaced-apart air flow channels, wherein the at least three vanes have respective planar trailing edge portions that are parallel with each other and with a surface of the work space floor, wherein the air flow channels extend into the chamber through the access opening and are substantially parallel with the floor surface, wherein air flow created within the chamber by the exhaust system causes the first airfoil assembly to produce controlled air flow patterns that sweep along the floor surface;

a sash slidably mounted to the chamber at the access opening and movable between raised and lowered positions; and a second elongated airfoil assembly attached to a lower edge portion of the sash, wherein the second airfoil assembly extends substantially an entire span of the sash and comprises first and second elongated vanes in vertically spaced-apart relationship that define an air flow channel that extends into the chamber through the access opening, wherein the first and second vanes each have an upwardly curved free leading edge portion and a planar free trailing edge portion that is substantially parallel with the floor surface, wherein air flow created within the chamber by the exhaust system causes the airfoil assembly to produce controlled air flow patterns into the chamber.

14. The fume hood of claim 13, wherein the first airfoil assembly comprises first, second, third, and fourth vanes, wherein the first, second and third vanes have respective trailing edges that are each located a first distance from a free end of the floor edge portion, wherein the fourth vane has a trailing edge that is located a second distance from the free end of the floor edge portion, wherein the second distance is less than the first distance.

15. The fume hood of claim 14, wherein the first, second and third vanes have respective first, second, and third widths, wherein the second width is greater than the first width, and wherein the third width is greater than the second width.

16. The fume hood of claim 15, wherein the first and second vane leading edge portions each have a radius of curvature relative to the respective first and second vane trailing edge portions of between about one degree and about twenty degrees (1°-20°), and wherein the third and fourth vane leading edge portions each have a radius of curvature relative to the respective third and fourth vane trailing edge portions of between about seventy degrees and about ninety degrees (70°-90°).

17. The fume hood of claim 14, wherein a thickness of the first, second, and third vanes is substantially constant along a width thereof, and wherein the fourth vane has a cross-sectional shape of an airfoil with a generally blunt leading edge portion that tapers to a trailing edge portion.

18. The fume hood of claim 13, wherein the second airfoil assembly vane positioned closest to the sash has a width that is less than a width of the other second airfoil assembly vane.

19. The fume hood of claim 18, wherein each of the second airfoil assembly vanes has a trailing edge that is located the same distance from a centerline of the sash.

20. The fume hood of claim 19, wherein the leading edge of the second airfoil assembly vane positioned closest to the sash is located at a position closer to a centerline of the sash than the leading edge of the other second airfoil assembly vane.

21. The fume hood of claim 13, wherein each second airfoil assembly vane has a cross-sectional shape of an airfoil with a generally blunt leading edge portion that tapers to a trailing edge portion.

22. The fume hood of claim 13, wherein the ventilated chamber has a rear wall, side walls, a ceiling, a floor and an access opening, and further comprising a baffle assembly located in front of the rear wall, the baffle assembly comprising:

a non-movable primary panel having opposite side edges attached to the respective chamber side walls and a lower edge spaced apart from the chamber floor, and wherein a plurality of generally vertical air-exit slots are formed within the primary panel adjacent the lower edge thereof in horizontal spaced-apart relationship; and a non-movable buffering panel positioned between the primary panel and rear wall so as to define an air flow path between the primary panel and buffering panel, wherein the buffering panel has opposite side edges attached to the respective chamber side walls and a lower edge spaced apart from the chamber floor, and wherein a pair of generally horizontal air-exit slots are formed within the buffering panel adjacent the upper portion thereof in horizontal spaced-apart relationship.

* * * * *